United States Patent [19]

Thomas et al.

[11] 4,225,997

[45] Oct. 7, 1980

[54] SELF-CLEANING BRUSH

[76] Inventors: William J. Thomas, #107-11771 King Rd., Richmond, British Columbia, Canada V7A 3B5; John E. Adam, 54 Qualicum St., Ottawa, Ontario, Canada K2H 7M4

[21] Appl. No.: 2,798

[22] Filed: Jan. 11, 1979

[51] Int. Cl.[3] ..... A46B 7/00

[52] U.S. Cl. ..... 15/184; 15/169

[58] Field of Search ..... 15/169, 184; 132/119–123, 9

[56] References Cited

U.S. PATENT DOCUMENTS

| | | | |
|---|---|---|---|
| 914,970 | 3/1909 | Nickerson et al. | 15/184 |
| 1,382,042 | 6/1921 | Wright | 15/169 |
| 1,776,443 | 9/1930 | Martin | 15/184 |
| 2,660,183 | 11/1953 | Gruring | 15/184 X |
| 3,065,757 | 11/1962 | Peilet | 15/184 X |

FOREIGN PATENT DOCUMENTS

| | | | |
|---|---|---|---|
| 1110368 | 10/1955 | France | 15/184 |

*Primary Examiner*—Philip R. Coe
*Attorney, Agent, or Firm*—Craig & Antonelli

[57] ABSTRACT

A self-cleaning brush comprises a body member having a hollow interior compartment and an anterior wall provided with a number of spaced apertures through which the bristles of the brush can project. A bristle supporting member, including a brush head to which the bristles are affixed, is located within the hollow compartment and has a brush head operating member attached to its upper surface which projects through an opening in a posterior wall. The brush head operating member is movable reciprocably within the hollow compartment from a first position, in which the bristles project through registering apertures in the anterior wall, to a second position, where the bristles are fully retracted within the brush body. The retraction of the bristles through the apertures in the anterior wall allows for easy removal of hair or debris from the bristles. The brush head operating member may be locked in any desired position by means of a reciprocable lever member which extends from the brush body. The inner end of the lever member constitutes a so-called "locking panel" which fits within one of a plurality of recesses located within the brush head operating member. When the lever is not engaged within one of the recesses in the brush head operating member, the brush head and bristles can be easily extended or retracted as desired.

9 Claims, 9 Drawing Figures

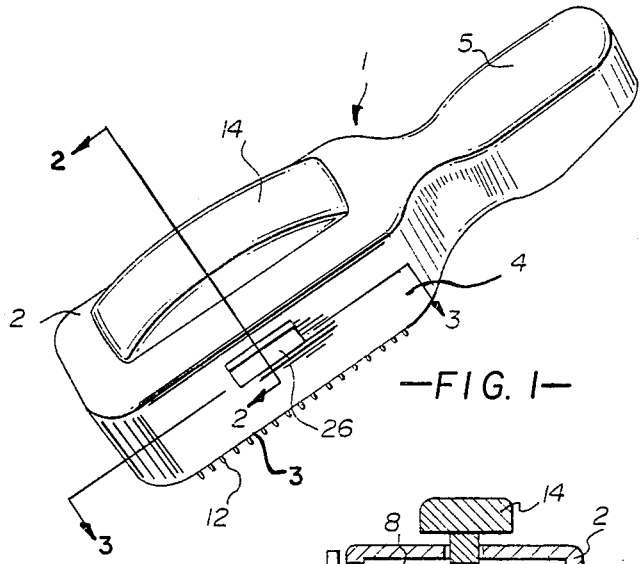
—FIG. 1—
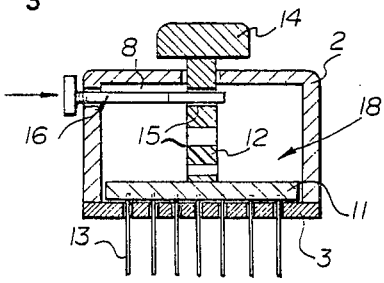
FIG. 2
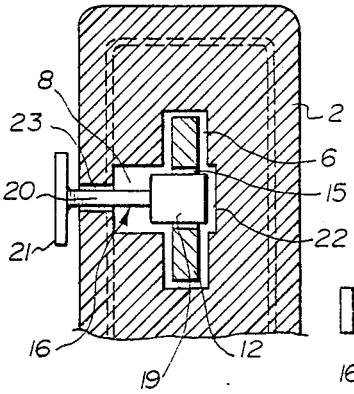
FIG. 3
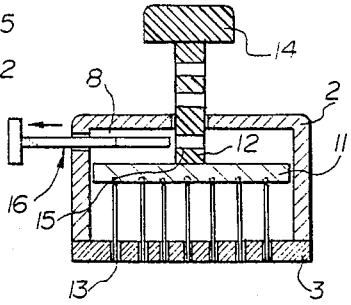
FIG. 4

SELF-CLEANING BRUSH

The present invention relates to a brush, and more particularly, to a self-cleaning brush in which the bristles of the brush can be retracted within apertures formed through the anterior wall of the brush to remove foreign materials such as hair, debris, etc., and the bristles can be readily held in place when the brush is in use for normal brushing purposes.

A brush, for example, a hair brush, tends to pick up foreign materials such as hair, debris, etc. which have to be removed from the brush bristles periodically by means of suitable means such as, for example, another brush, or a comb. It is rather time-consuming and is often inconvenient to remove such foreign materials in such conventional manner.

There have been proposed a number of so-called self-cleaning brushes which are equipped with means to remove such foreign materials from bristles, and these have been employed to some extent. For example, U.S. Pat. No. 2,529,927 issued Nov. 14, 1950 to H. W. Fisk and U.S. Pat. No. 2,916,757 issued Dec. 15, 1959 to L. R. Peilet et al disclose a mobile cleaning plate whose relative movement to the brush body is limited. The cleaning plates are lifted by fingers while retaining their respective brush bodies. U.S. Pat. 2,916,756 issued Dec. 15, 1959 to L. R. Peilet et al discloses a double acting self-cleaning retractable brush. Referring to FIGS. 1 and 2 of the patent, for cleaning purposes, the upper housing member 18 is turned in one direction. By this action, the bristle carrying member 22 descends within the lower housing member 20 while rotating with the upper housing member 18, thus allowing a compact structure.

U.S. Pat. 2,660,183 issued Nov. 24, 1953 to A. Grüring also discloses a self-cleaning brush. The bristles supporting plate 30 and comb supporting plate 32 are raised or lowered by means of the respective control screws 20 and 22. The cover plate 50, which defines a plurality of apertures therethrough, is integral with the handle body or casing 10 and therefore is stationary. The bristles 40 and combs 42 can be retracted within the handle body or casing 10.

The self-cleaning brushes disclosed in U.S. Pat. Nos. 2,916,756 and 2,916,757 do not contain any locking mechanism which is adapted to retain the bristles in place when the brushes are in use for normal brushing purposes. Accordingly, the cleaning plates may move during the course of the use of the self-cleaning brushes, thus hampering the brushing application.

The self-cleaning brush according to the invention disclosed in U.S. Pat. No. 2,529,927 includes a locking mechanism which normally retains the cleaning plate in a locked position. The cleaning plate is, however, mobile; and the bristles are normally exposed. In order to clean the bristles, the hooks 13 have to be first released from their locked position one by one. This is rather slow and cumbersome.

According to the drawings of U.S. Pat. No. 2,660,183, and particularly FIGS. 3 to 6, a bristle or comb supporting plate is attached to the free end of its respective screw. A firm attachment would cause the supporting plate to move with difficulty, and a loose attachment would render it unstable and susceptible of breakage.

Another example of a self-cleaning brush is disclosed in U.S. Pat. No. 3,110,053, issued Nov. 12, 1963, to E. C. Surabian. Surabian provides a foraminous cleaning plate (18) through which the bristles (12) of the brush pass. This plate is normally held against the under surface on the back of the brush by spring members (26,28). Plate (18) has a central post (22) projecting upwardly through an aperture in the back of the brush, and one end of each of the springs is fitted into a notch on the upper end of the post (22). By pushing down on the springs the plate (20) with the post (22) is pushed outwardly toward the ends of the tufts of bristles, permitting cleaning of the brush, and when the pressure on the springs is released they revert to their normal arcuate positions, thus causing retraction of the foraminous cleaning plate. Since the cleaning plate (20) is mobile, the bristles are exposed; due to the use of spring members, the manufacturing cost would be rather high and it would be susceptible of breakage.

An objective of the present invention is to provide a self-cleaning brush which is of simple and inexpensive construction, and which operates easily and effectively.

A further, more specific objective of this invention is to provide a self-cleaning brush in which the bristles thereof may be readily drawn into and out of the main body of the brush in order that foreign materials such as hair, debris, etc., can be easily removed from the face of the brush; and having locking means operable so that when the bristles are in their extended or operating position, they can be locked into this position ready for use.

The present invention, in its broadest aspect, resides in a self-cleaning brush comprising a brush body member comprising a posterior wall having a first opening therethrough, an anterior wall member having therein a plurality of spaced apertures, and a side wall integrally joined with the posterior and anterior walls, said walls defining a hollow compartment in the interior of the body member, said first opening in said posterior wall communicating with said hollow interior compartment; a reciprocably movable bristle supporting member generally disposed within the hollow compartment and comprising a brush head from whose lower surface a plurality of bristles extend in registration with the apertures in said anterior wall member; and a brush head operating member integral with the upper surface of the brush head, and extending in a plane perpendicular to the axis of the brush body member through said first opening in the posterior wall, and projecting above said posterior wall; said brush head operating member being adapted to move reciprocably within the hollow compartment from a first fully extended position in which the brush head is in juxtaposition with said anterior wall member and said bristles project through their respective apertures in said anterior wall member, to substantially their full length, at which position the brush is operable as such; to a second retracted position in which the brush head is in juxtaposition with the inner surface of the posterior wall of said brush body member, at which position the bristles are fully retracted within the body, the tips of said bristles being within the apertures in said anterior wall member, thereby to allow the easy removal of hair or debris from said bristles.

In another, more particular aspect of this invention there is provided a self-cleaning brush as described in the immediately preceding paragraph, which further includes a locking mechanism adapted to lock the bristle supporting means when the brush is in use for brushing. The locking mechanism comprises a lever member which extends from the exterior of the brush body adjacent the side wall through a second opening formed in the brush body, in a plane normal to the longitudinal axis of said brush body, and at least one recess formed in the bristle supporting member and adapted to receive at least the inner end portion of the lever member, said lever member being adapted for reciprocable motion into and out of engagement with said recess in said bristle supporting member.

The advantages derived from the present invention are numerous. For example, the bristle supporting means is mobile and therefore the bristles can be retained within the brush body to protect the bristles, when it is not in use, particularly when it is carried in a bag. Where the self-cleaning brush according to this invention is not equipped with a locking mechanism, a user must hold the bristle supporting means in place at the free end of the brush head operating member. This is not necessary where the self-cleaning brush is provided with such a locking mechanism as described above. Either way, the brush head is held in place when the brush is applied, and the brush operation will not be hampered. The construction of the self-cleaning brush of the present invention is rather simple, and thus simple to use, inexpensive to manufacture and less susceptible to breakage.

Other features and advantages of the present invention will become more apparent from the following detailed description of a preferred embodiment of this invention, with reference to the appended drawings, in which:

FIG. 1 is a perspective view of a preferred embodiment in which the brush is ready for application; the bristles being in their extended position;

FIG. 2 is an enlarged cross-sectional view of the brush shown in FIG. 1, taken along the line II—II, thereof;

FIG. 3 is an enlarged cross-sectional view of the brush shown in FIG. 1 taken along the line III—III, showing the brush when in the locked position;

FIG. 4 is a view similar to that of FIG. 2, but in which the bristles of the brush have been retracted and hair has been removed from the bristles.

Figure 6:
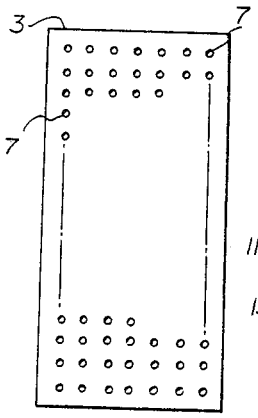
FIG. 6 is a plan view of the anterior plate member.

Referring now to the drawings, the brush body 1, which may be constructed of any suitable material such as wood, metal or plastic, is in the form of a shell; and comprises a posterior wall 2, an anterior wall member or plate 3, and a side wall 4 extending between the peripheries of the posterior wall 2 and anterior plate 3, the side wall being integral with said posterior wall, and also being integrally connected to the anterior plate 3. The posterior and side walls, and anterior wall plate 3, define a central cavity 18. The brush body 1 is also provided with a handle 5 for convenience; this may be, if present, an integral part of the brush body. The handle 5 is, however, optional and may be omitted if desired. A first opening 6 communicating with central cavity 18 is centrally located in the posterior wall 2, and the anterior plate 3 has therein a plurality of spaced apertures 7 (see FIG. 6). The posterior wall 2 also has a second opening 8 extending perpendicularly to the longitudinal axis of the brush body 1 and communicating with the first opening 6. The side wall 4 has, at a location where it is integrally connected with the posterior wall 2, an aperture 23 which is in communication with said second opening 8 in the posterior wall.

The main body 1 houses a reciprocably movable bristle supporting means which consists of a brush head 11 and a brush head operating member 12 which is integral with the brush head 11 and extends from the upper surface of the brush head 11 in a plane perpendicular to the axes of brush body 1 and of bristle head 11, through opening 6, and projects slightly above posterior wall 2. The brush head 11 supports a plurality of bristles 13 which are rigidly affixed to said brush head 11 and extend from the lower surface thereof in a pattern in registration with the plurality of apertures 7 formed through the anterior wall 3. The brush head operating member 12 is provided with a grasping knob 14 at the opposite end thereof to the bristle head 11 (its free or proximal end). Grasping knob 14 is located outside posterior wall 2 of the brush, and is firmly affixed to the proximal end of member 12. The bristle head operating member 12 and bristle head 11 to which it is connected are both somewhat plate-like in form. A plurality of recesses 15 are formed in spaced-apart relationship in the brush head operating member 12, which recesses 15 are adapted to engage the distal end portion, which may be designated as a locking panel 19, of a lever member 16, which extends through the aperture 23 in the side wall 4 at a location where said side wall is integrally joined with posterior wall 2, and thence through the second opening 8 in said posterior wall.

Lever member 16 comprises at one end (its distal end) a plate-like member, denoted here as a locking panel 19, rectangular in outline, which is integrally connected to a stem portion 20 which projects therefrom perpendicularly to the longitudinal axis of said locking panel 19 (and in a plane normal to the longitudinal axis of brush body 1), and extends through opening 8 and aperture 23 to the exterior of body 1, adjacent the juncture of side wall 4 with posterior wall 2. To the proximal end of stem portion 20 of lever member 16 is attached a grasping member or knob 21, which enables lever member 16 to be moved readily into and out of locking engagement with the brush head operating member 12, as desired.

Figure 7:
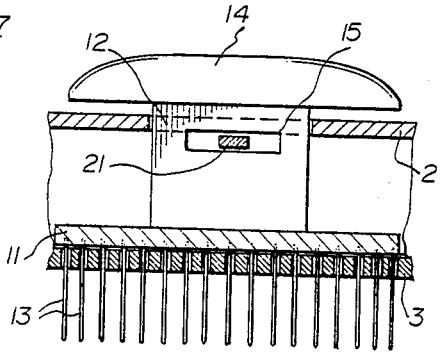
FIG. 7 is a side elevational view of the movable bristle supporting means, with attached bristles, with the bristles being in their extended position.
Figure 8:
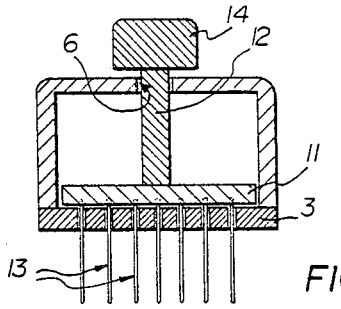
FIG. 8 is an end elevational view of the movable bristle supporting means with attached bristles.
Figure 9:
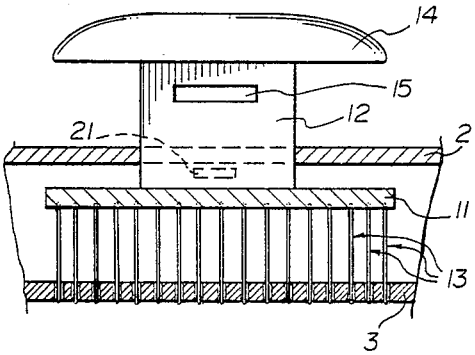
FIG. 9 is a side elevational view of the movable bristle supporting means, showing the bristles in their retracted position.

To illustrate the way in which our self-cleaning brush may be used for brushing, reference is made to FIGS. 2, 3 and 7 of the drawings.

The brush head operating member 12 is pushed down until the bristles protrude to a desired length beyond anterior plate 3 of the brush, as shown clearly in FIGS. 2 and 7. When the bristles extend through the apertures to their full length, as is illustrated in FIGS. 2 and 7, brush head 11 will be in juxtaposition with anterior plate 3. Then the lever member 16 is pushed inwardly (see FIG. 3) so that locking panel 19 extends into recess 15 (and desirably completely through said recess 15, the recess being an aperture in member 12). In this position, the lever member 16 serves as a locking means, and prevents upward movement of the operating member 12 and bristles 13. The length of bristles protruding from the brush can be adjusted by making an appropriate selection of recess or aperture 15 into which the lever member 16 is to be pushed into locking engagement. The brush is also operable without the recesses 15 and the lever member 16. In this case, a user must hold the grasping knob 14 beneath the palm of his (her) hand while his (her) fingers hold the side wall 4 of the brush body 1. Otherwise the bristles 13 would tend to move inwardly, thereby hampering operation of the brush. It is preferred to form several recesses 15 in the brush head operating member 12 in order to allow for adjustment of the length of the bristle 13 protruding from the anterior wall 3, as desired, depending on such factors as, for instance, the length of hair to be brushed. The apertures 7 are of a diameter sufficient to permit easy passage therethrough of bristles 13, and thereby prevent the same from being bent, but not being large enough to allow the passage of hair or other debris clinging to the bristles after brushing is completed, into the interior cavity 18 of the brush.

Figure 5:
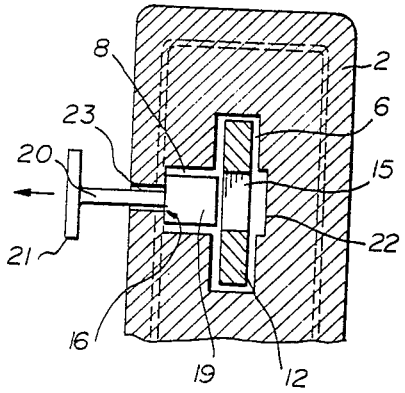
FIG. 5 is a view similar to that of FIG. 3 but in which the locking mechanism is in the same position as in FIG. 4.

After use of our device for brushing, the brush may be cleaned in the following manner, making reference here to FIGS. 4 and 5 of the drawings. After brushing, the bristles 13 of the brush normally carry a quantity of hair. To remove the hair from the bristles, the lever member 16 is first released from locking engagement with one of the recesses 15. By pulling outwardly on grasping knob 21; this causes the locking panel 19 of lever member 16 to slide out of engagement with recess 15. Then, the bristle supporting means is pulled in a direction away from the anterior plate 3 by means of grasping knob 14 until the free ends of the bristles 13 are retracted within their respective apertures 7. When the bristles are fully retracted, the brush head 11 will be in juxtaposition with the inner surface of posterior wall 2. The retraction of the bristles 13 within the brush body causes the hair to disengage from said bristles, since apertures 7 are large enough to permit only the passage of the bristles therethrough. Thus the hair is left behind on the outer surface of the anterior plate 3, ready to discard. Thus the anterior plate 3, viz. the front face of the brush, can be cleaned readily without having the bristles interfere with the cleaning act.

The recesses 15 preferably take the form of apertures in operating member 12, the apertures being dimensioned such that they will slidably receive locking panel 19 of lever member 16. The second opening 8 may be further extended into the opposite side of the posterior wall 2, to form a recess 22 therein on the side of said first opening therein, opposite to that which is adjacent opening 8, thereby to allow the lever member 16 to extend through a substantial length of the posterior wall 2, and into recess 15 in the form of a hole in the brush head operating member 12; this provides added security in locking the bristles in place when the brush is in operative position.

The second opening 8 may be formed through the side wall 4 but is advantageously formed through the posterior wall 2 for better support, as indicated above.

The lever member 16 and the bristle supporting member 11, with associated knobs 21 and 14 respectively, may be constructed of any suitable material, of the same class of materials from which body member 1 of the brush is constructed. Preferably, the lever member and the bristle supporting member will be made of the same material as that from which body member 1 is constructed.

Although the present invention has been described with reference to a preferred embodiment, it will be appreciated that various modifications are feasible without departing from the spirit of this invention. It is intended, then, that this invention be limited only by the claims which follow.

We claim:

1. A self-cleaning brush comprising a brush body member comprising a posterior wall having a first opening therethrough, an anterior wall member having therein a plurality of spaced apertures, and a side wall integrally joined with the posterior and anterior walls, said walls defining a hollow compartment in the interior of the body member, said first opening in said posterior wall communicating with said hollow interior compartment; a bristle supporting member generally disposed within the hollow compartment and comprising a brush head from whose lower surface a plurality of bristles extend in registration with the apertures in said anterior wall member; and a brush head operating member integral with the upper surface of the brush head, and extending in a plane perpendicular to the axis of the brush body member through said first opening in the posterior wall, and projecting above said posterior wall; said brush head operating member being adapted to move reciprocably within the hollow compartment from a first fully extended position in which the brush head is in juxtaposition with said anterior wall member and said bristles project through their respective apertures in said anterior wall member, to substantially their full length, at which position the brush is operable as such; to a second retracted position in which the brush head is in juxtaposition with the inner surface of the posterior wall of said brush body member, at which position the bristles are fully retracted within the body, the tips of said bristles being within the apertures in said anterior wall member, thereby to allow the easy removal of hair or debris from said bristles; said bristle supporting member being reciprocably movable by manual operation of the free end of said brush head operating member; and further comprising a locking mechanism adapted to lock the bristle supporting member when the brush is in use, said locking mechanism comprising a lever member which extends from the exterior of the brush body adjacent the side wall through a second opening formed in the brush body, in a plane normal to the longitudinal axis of said brush body, and at least one recess formed in the bristle supporting member and adapted to receive at least the inner end portion of the lever member, said lever member being reciprocably movable into and out of engagement with said recess in said bristle supporting member by manual operation of its free end, such manual operation being facilitated by a knob which is attached to said free end of said lever member.

2. The self-cleaning brush of claim 1, wherein the inner end portion of said lever member is configured as a locking panel, said locking panel being of a width greater than the width of said second opening formed in said brush body, whereby the locking panel is prevented from movement through said second opening thus preventing said lever member from becoming totally disengaged from said brush body during any reciprocable movement of said lever member.

3. A self-cleaning brush according to claim 2 wherein said brush head operating member is adapted to move reciprocably within the hollow compartment to any one of a plurality of selected positions within a range of such positions from said first fully extended position to said second retracted position, said range including said first and second positions.

4. The self-cleaning brush according to claim 2 wherein the second opening is formed through the posterior wall.

5. The brush according to claim 2 or 4, wherein the recess adapted to receive at least the inner end portion of the lever member is formed in the brush head operating member.

6. The brush according to claim 2 or 4 wherein a plurality of spaced recesses or holes are formed in or through the brush head operating member to allow for adjustment of the lengths of the bristles to be extended outwardly from the anterior wall of the brush body.

7. The brush according to claim 4 wherein the second opening is formed through the posterior wall from one side thereof to a point beyond said first opening and said brush head operating member has formed therein a hole of dimensions such as to slidably receive the inner end portion of said lever member.

8. The brush according to claim 2, wherein the brush head operating member is provided at its free end with a knob to facilitate manual operation of said brush head operating member.

9. The brush according to claim 2, wherein a handle is integrally attached to the brush body.

* * * * *